United States Patent [19]

Valley

[11] Patent Number: 4,877,278

[45] Date of Patent: Oct. 31, 1989

[54] RETAINER FOR DOOR HANDLE

[76] Inventor: Harold J. Valley, 2046 Badger Glen, Escondido, Calif. 92025

[21] Appl. No.: 312,953

[22] Filed: Feb. 17, 1989

[51] Int. Cl.[4] ..... E05C 21/00

[52] U.S. Cl. ..... 292/350; 292/357; 292/356

[58] Field of Search ..... 292/350, 351, 251, 356, 292/357; 411/417; 403/156

[56] References Cited

U.S. PATENT DOCUMENTS

| | | | |
|---|---|---|---|
| 1,619,097 | 3/1927 | Archer | 292/350 X |
| 2,904,989 | 9/1959 | Best | 292/357 X |
| 4,067,599 | 1/1978 | Ohno | 292/356 |
| 4,790,702 | 12/1988 | Maganias | 411/417 X |

*Primary Examiner*—Richard E. Moore

*Attorney, Agent, or Firm*—Cahill, Sutton & Thomas

[57] ABSTRACT

A shaft of a door handle to be installed in a door includes a limited length threaded segment for engaging a commensurately threaded rose to effect penetration and subsequent threaded disengagement therebetween. The threaded disengagement permits relative rotation without axial displacement and axial withdrawal of the shaft is prevented due to interference between the threaded segments. Upon positional locking of the rose with the door and mating of the door handle with a door bolt, the resulting limited relative rotation between the door handle and the rose in combination with the axial displacement limited by the interfering thread segments prevent threaded disengagement and removal of the door handle.

14 Claims, 1 Drawing Sheet

RETAINER FOR DOOR HANDLE

BACKGROUND OF THE INVENTION

1. Field of the Invention

The present invention relates to retainers for door handles and, more particularly, to an interlock between a door rose and a door handle.

2. Description of the Prior Art

Most door handles and door knobs for lockingly or otherwise operating a door bolt include a square or splined shaft for engaging a bolt mechanism. Upon rotation of the shaft, the bolt is withdrawn to permit opening of a door. The shaft is operationally secured with the door handle or door knob to obtain commensurate rotation upon pivotal movement of the door handle or rotation of the door knob. A rose, secured to the door, is commonly used to secure the door handle or door knob in place and to penetrably receive the shaft of the door handle or door knob. Necessarily, the door handle or door knob must be able to rotate relative to the rose.

To bring about these relationships between the door handle or door knob and the rose, devices must be employed which permit relative rotation therebetween but preclude axial displacement of the door handle or door knob from the rose. Such axial retention can be effected by employing a snap ring locked within an annular groove in the shaft of the door handle or door knob and bearing against a shoulder of the rose. Alternatively, a set screw can be employed in place of the snap ring. While both of these types of devices serve the intended purpose, certain deficiencies exist. In particular, a certain amount of play is designed into the locking mechanism to minimize wear due to friction. Where play is reduced in order to obtain a more firm feel of the door handle or door knob, wear usually becomes a problem. Set screws tend to loosen over a period of time and may result in disengagement of the door handle or door knob. If a rose or door handle or door knob is to be replaced for decorative or other purposes, special tools are usually required to remove and reassemble the components.

SUMMARY OF THE INVENTION

A centrally apertured rose, attachable to a door in operative relationship to a door bolt, supports a door handle or door knob. An outer segment of the aperture in the rose is threaded and an inner segment is an annular groove commensurate in width and depth with the threaded segment. The hollow shaft of a door handle or door knob includes a threaded segment commensurate in axial displacement with that of the rose for threaded engagement therewith. An annular groove in the shaft extends axially from the threaded segment a sufficient distance to receive the threaded segment of the rose. Upon threadedly engaging the shaft with the rose, the threaded segment of one will become positioned in the annular groove of the other and further relative rotation will not produce commensurate axial displacement. Accordingly, the shaft is freely rotatable with respect to the rose and axial displacement therebetween, without commensurate rotation, is precluded due to interference between the threaded segments. Upon securing the rose to the door and the door handle or door knob with a bolt actuating spindle, relative rotation between the rose and the door handle or door knob is limited and disengagement between the door handle or door knob is precluded by interference between the threaded segments, except upon detachment of the rose with the door.

It is therefore a primary object of the present invention to provide an interlock for securing a door handle or door knob with a rose in a door.

Another object of the present invention is to provide a locking engagement between a rose and a door handle or door knob.

Still another object of the present invention is to provide a readily assembleable and disassembleable rose and door handle or door knob which does not require special tools.

Yet another object of the present invention is to provide structural interaction between a rose and a door handle or door knob which avoids the necessity for further elements to prevent displacement therebetween.

A further object of the present invention is to provide a replacement rose and door handle or door knob which do not require special tools for installation.

A still further object of the present invention is to provide a simplified door handle or door knob and mounting assembly.

A yet further object of the present invention is to provide a method for attaching door handles or door knobs.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Conventional door handles and door knobs include a shaft rotatably mounted in a rose. Disengagement between the shaft and the rose may be prevented by a snap ring, one or more tangs or a set screw. Usually, the interconnection between the shaft and the rose permits a relatively substantial axial and lateral displacement, or play, to minimize wear between the parts. Upon initial installation, little trouble or difficulty is encountered. However, upon disassembly for replacement of either the rose or the door handle or door knob, special tools are required and a certain amount of difficulty is encountered.

Figure 1:
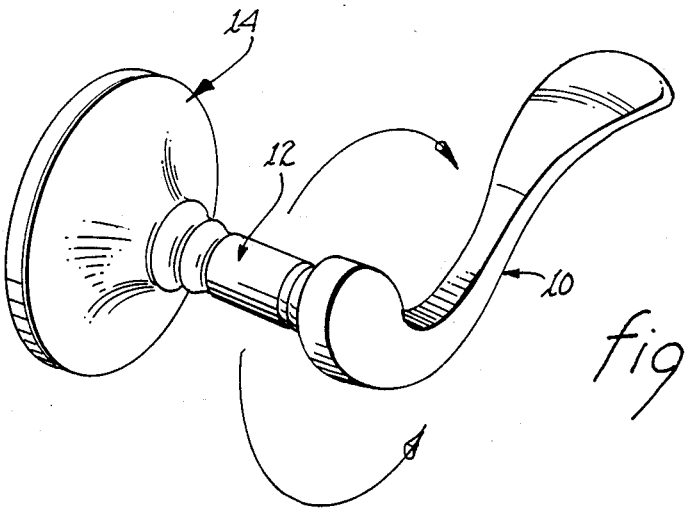
FIG. 1 is a perspective view of a door handle attached to a rose.

Referring to FIG. 1, there is shown a door handle 10 which is representative of innumerable configurations of door handles. It is further understood that the door handle shown could be replaced with any of numerous configurations or door knobs and the terms door handle and door knob are used synonymously herein above and below. A shaft 12 extends from the door handle and includes an internal passageway for receiving a spindle; the shaft may be rectangular in cross section (as is common) or it may be splined. The function of the spindle is that of actuating a lock mechanism to draw a bolt into an associated door (as is well known). A rose 14 is secured to the surface of a door and serves four purposes. First, it rotationally supports shaft 12. Second, it retains shaft 12. Third, it covers the opening(s) in a door necessary to install the lock mechanism. Fourth, it provides a decorative effect in combination with the door handle.

The interconnection between rose 14 and shaft 12 will be described in further detail with reference to FIGS. 2 and 3. Handle 10 includes a passageway 20 for receiving open end 22 of shaft 12. A threaded stud 24 in threaded engagement with threads 26 includes a head 28 for drawing the handle onto the shaft. Rotation of the threaded stud is effected by inserting a screwdriver into passageway 30 extending through shaft 12 and engaging slot 32 in the threaded stud.

The other end of shaft 12 includes a threaded segment 36 and an adjacent annular groove 38. The radius of groove 38 is equal to or less than the radius at the base of threaded section 36. A journal 40 is defined by shoulder 42 of groove 38 and a further shoulder 44. The remaining exposed part of shaft 12 may be configured in a manner dictated primarily by aesthetic considerations.

Rose 14 is centrally apertured by passageway 50 wherein is disposed threaded section 52 for mating engagement with threaded section 36 of shaft 12. The axial length of threaded section 52 may be essentially commensurate with that of threaded section 36. Moreover, the axial length of threaded section 52 is commensurate with the width of groove 38. Annular groove 54 is adjacent threaded section 52 and of a depth commensurate with that of threaded section 52. The width of annular groove 54 is commensurate with the width of threaded segment 36 of shaft 12. A journal 56 is defined by shoulder 58 and end 60 of a central cone shaped extension 62 of rose 14. A bushing 66 is disposed intermediate journal 56 of rose 14 and journal 40 of shaft 12 and between shoulder 58 of the rose and shoulder 44 of the shaft. The bushing may include a lip 64 bearing against end 60.

Figure 2:
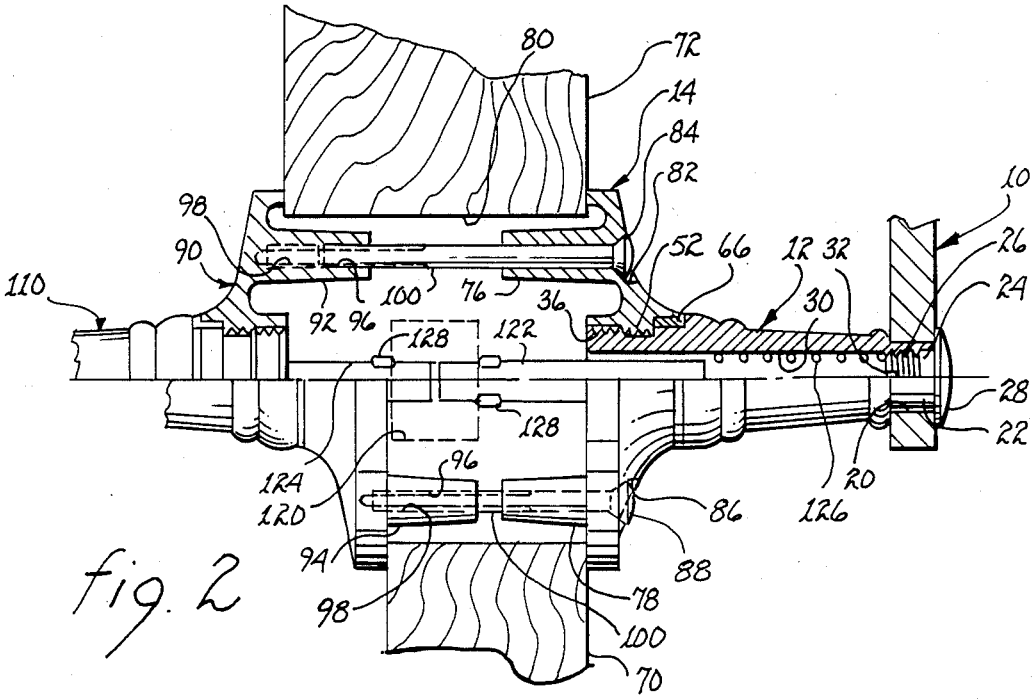
FIG. 2 is a partial cross sectional view illustrating the operative elements for detachably attaching a door handle to a door, which door may have any thickness within a predetermined range.
Figure 3:
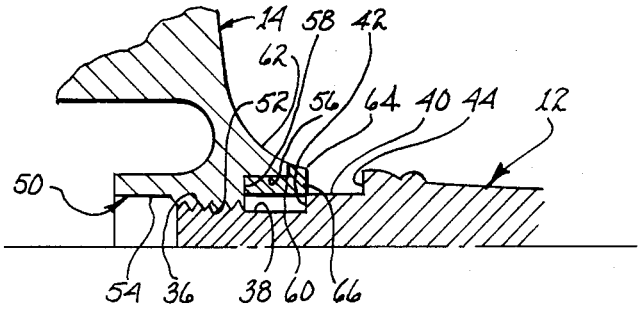
FIG. 3 is a partial cross sectional view detailing an interlock between the shaft of a door handle and an associated rose.

As particularly illustrated in FIG. 2, means are provided for accommodating a door 70 having a thickness of approximately 1¼" to a door 72 having a thickness of approximately 2". Doors within this range of thickness are considered standard doors for which the width dependent hardware attendant the door lock mechanism and rose attachment mechanism are generally available. Clearly, thinner or thicker doors can be accommodated by appropriate dimensioning of the hardware.

Rose 14, configured to be the rose disposed on the inside of a door, includes a pair of diametrically opposed hollow studs 76,78. These studs extend into a generally circular passageway 80 formed within a door. An opening 82 permits insertion of a bolt 84 through stud 76. A similar opening 86 provides penetrable access of bolt 88 into and through stud 78. Rose 90 is intended for use on the outside of a door. It is identical with rose 14 except that each of its diametrically opposed studs 92,94 each include a cavity 96 instead of a passageway. At least a part of each cavity 96 is threaded with threads 98 for engagement by threads 100 of the respective bolts (84,88). The interconnection mechanism between door handle shaft 110 and rose 90 is duplicative of that described above with respect to the interconnection between door handle shaft 12 and rose 14.

A door lock mechanism, shown in cross section and referenced by dashed line 120, is mounted within a commensurately sized laterally extending passageway in the door. The terminal end of the door lock mechanism is disposed within passageway 80. Spindles 122,124 are slideably insertable within shafts 12,110, respectively. Usually, the spindles are square in cross section (however, they may be splined). The passageway in each shaft includes a similar cross section to mate with the respective spindle whereby rotation of the shaft will produce a commensurate rotation of the respective spindle. The rotating spindle, in turn, is keyed with door lock mechanism 120 to bring about retraction and extension of the associated bolt. A coil spring 126 is disposed within passageway 30 of shaft 12 to urge spindle 122 into door lock mechanism 120. Stops 128 may be disposed about the spindle to limit the extent of insertion of the spindle into the door lock mechanism. A similar spring may be used with shaft 110 and similar stops 128 may be used with spindle 124.

Shaft 12, after handle 10 has been attached thereto, is brought into threaded engagement with rose 14. Upon further relative rotation therebetween, threaded segment 52 will become lodged within groove 38 of shaft 12. Simultaneously, threaded section 36 will become lodged within groove 54 of rose 14. In this location of the threaded segments, the shaft is freely rotatable within rose 14 without resulting in axial displacement therebetween. The bearing surfaces during such rotation are bushing 66 in combination with journal 40 of shaft 12 and journal 56 of rose 14. Axial displacement, without relative rotation, is prevented by interference of one threaded section with the other. Obviously, relative rotation in conjunction with axial displacement of shaft 12 relative to rose 14 will reengage the threaded sections and separation between the shaft and the rose will result.

Upon assembly of shaft 12 with rose 14 and shaft 110 with rose 90, spindles 122,124 are inserted into their respective shafts. Insertion and threaded tightening of bolts 84,88 will secure rose 14 and rose 90 to each other and to the door and rotation of either of the roses is precluded. Rotational movement of either of shafts 12,110 is limited by the interaction of the respective spindle with the door lock mechanism. As described above, axial displacement of either of shafts 12,110, from the respective roses 14, 90, is precluded due to interference between the threaded segments. Because of the limited rotation available to either of the shafts, disengagement between the threaded segments cannot come about. Furthermore, axial displacement of either of the shafts is precluded.

To replace either a rose, a shaft or a handle, bolts 84,88 are unscrewed to release the opposing roses from the door and from one another. Thereafter, each shaft can be disengaged from its respective rose by providing relative rotation therebetween in combination with axial displacement to effect initial threaded engagement and subsequent threaded disengagement between threaded segments 36 and 52. Replacement of any or all parts is readily accomplished. After replacement, reassembly is relatively rapid and facile.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for detachably attaching the end of a shaft extending from a door handle to an apertured rose having a passageway extending therethrough, said apparatus comprising in combination:

(a) a first threaded segment disposed proximate and about the end of the shaft;

(b) a second threaded segment disposed in the passageway of the rose for threadedly engaging said first threaded segment;

(c) a first annular groove disposed adjacent said first threaded segment and about the shaft for receiving said second threaded segment upon insertion of the shaft in the passageway of the rose and after said first threaded segment has been axially threadedly displaced past said second threaded segment;

(d) a second annular groove disposed adjacent said second threaded segment in the passageway of the rose for receiving said first threaded segment upon insertion of the shaft in the passageway of the rose and after said second threaded segment has been axially threadedly displaced past said first threaded segment; and (e) journal means for rotatably supporting the shaft within the rose when said first threaded segment is in said second annular groove and said second threaded segment is in said first annular groove.

2. The apparatus as set forth in claim 1 wherein said journal means includes a bushing disposed intermediate the shaft and the rose.

3. The apparatus as set forth in claim 1 wherein said first threaded segment is at the extremity of the shaft.

4. The apparatus as set forth in claim 1 wherein said second annular groove is at the inner extremity of the passageway.

5. The apparatus as set forth in claim 4 wherein said first threaded segment is at the extremity of the shaft.

6. Apparatus for securing a door handle in operative engagement with the lock mechanism of a door, said apparatus comprising in combination:

(a) a shaft extending from said door handle;

(b) a rose attachable to the door for supporting said shaft, said rose including a passageway for receiving said shaft;

(c) a first threaded segment disposed proximate and about the end of said shaft;

(d) a second threaded segment disposed in said passageway of said rose for threadedly engaging said first threaded segment;

(e) a first annular groove disposed adjacent said first threaded segment and about said shaft for receiving said second threaded segment upon insertion of said shaft in said passageway of said rose and after said first threaded segment has been axially threadedly displaced past said second threaded segment; and (f) a second annular groove disposed adjacent said second threaded segment in said passageway of said rose for receiving said first threaded segment upon insertion of said shaft in said passageway of said rose and after said second threaded segment has been axially threadedly displaced past said first threaded segment.

7. The apparatus as set forth in claim 6 including means for limiting rotation of said shaft relative to said rose after engagement of said shaft with the lock mechanism to prevent threaded disengagement between said shaft and said rose.

8. The apparatus as set forth in claim 7 including a spindle for interconnecting said shaft with the lock mechanism.

9. The apparatus as set forth in claim 6 wherein said door handle extends from one side of the door and including:

(a) a further door handle in operative engagement with the lock mechanism of the door and extending from the other side of the door;

(b) a further shaft extending from said further door handle;

(c) a further rose attachable to the other side of the door for supporting said further shaft, said further rose including a further passageway for receiving said further shaft;

(d) a further first threaded segment disposed proximate and about the end of said further shaft;

(e) a further second threaded segment disposed in said further passageway of said further rose for threadedly engaging said further first threaded segment;

(f) a further first annular groove disposed adjacent said further first threaded segment and about said further shaft for receiving said further second threaded segment upon insertion of said further shaft in said further passageway of said further rose and after said further first threaded segment has been axially threadedly displaced past said further second threaded segment; and (g) a further second annular groove disposed adjacent said further second threaded segment in said further passageway of said further rose for receiving said further first threaded segment upon insertion of s id further shaft in said further passageway of said further rose and after said further second threaded segment has been axially threadedly displaced past said further first threaded segment.

10. The apparatus as set forth in claim 9 including means for limiting rotation of said shaft relative to said rose after engagement of said shaft with the lock mechanism to prevent threaded disengagement between said shaft and said rose and further means for limiting rotation of said further shaft relative to said further rose after engagement of said further shaft with the lock mechanism to prevent threaded disengagement between said further shaft and said further rose.

11. The apparatus as set forth in claim 6 including journal means for supporting said shaft within said rose when said first threaded segment is in said second annular groove and said second threaded segment is in said first annular groove.

12. The apparatus as set forth in claim 11 wherein said journal means includes a bushing disposed intermediate said shaft and said rose.

13. The apparatus as set forth in claim 9 including journal means for supporting said shaft within said rose when said first threaded segment is in said second annular groove and said second threaded segment is in said first annular groove and further journal means for supporting said further shaft within said further rose when said further first threaded segment is in said further second annular groove and said further second threaded segment is in said further first annular groove.

14. The apparatus as set forth in claim 13 wherein said journal means and said further journal means include a bushing and a further bushing disposed intermediate said shaft and said rose and said further shaft and said further rose, respectively.

* * * * *